United States Patent [19]

Heimberger

[11] 4,051,579

[45] Oct. 4, 1977

[54] SLIDE FASTENER SUPPORT AND METHOD OF WARP-KNITTING SAME

[75] Inventor: Helmut Heimberger, Locarno, Switzerland

[73] Assignee: Optilon W. Erich Heilmann GmbH, Cham, Switzerland

[21] Appl. No.: 728,132

[22] Filed: Sept. 30, 1976

[30] Foreign Application Priority Data

June 15, 1976 Germany ..... 2626664

[51] Int. Cl.[2] ..... D04B 21/00; A44B 19/00

[52] U.S. Cl. ..... 24/205.16 R; 66/195

[58] Field of Search ..... 66/190–195; 24/205.1 C, 205.16 C, 205.16 R

[56] References Cited

U.S. PATENT DOCUMENTS

| | | | |
|---|---|---|---|
| 3,570,270 | 3/1971 | Koppenburg | 66/190 |
| 3,848,556 | 11/1974 | Terada | 66/195 X |
| 3,849,842 | 11/1974 | Yoshida | 66/195 X |
| 3,864,946 | 2/1975 | Matsuda | 66/193 |
| 3,926,017 | 12/1975 | Matsuda | 66/195 |

*Primary Examiner*—Ronald Feldbaum
*Attorney, Agent, or Firm*—Karl F. Ross

[57] ABSTRACT

A slide-fastener support tape is formed with a Raschel knitting machine having a pair of needle bars. A relatively thin first warp yarn is chained with both of the needle bars to form a longitudinally extending double wale. A plurality of relatively thin second warp yarns are chained with only one of the needle bars into an array of longitudinally extending and transversely spaced single wales spaced by a gap from the double wale. A relatively thick warp yarn is blind lapped into this gap and is held thereon on one side by a weft yarn lapped by one of the needle bars between the double wale and the single wale at the edge of the array and on the other side by another weft yarn lapped by the other needle bar between the double wale and the edge single wale. In addition a plurality of weft yarns are laid into the single wales.

13 Claims, 4 Drawing Figures

FIG. 4
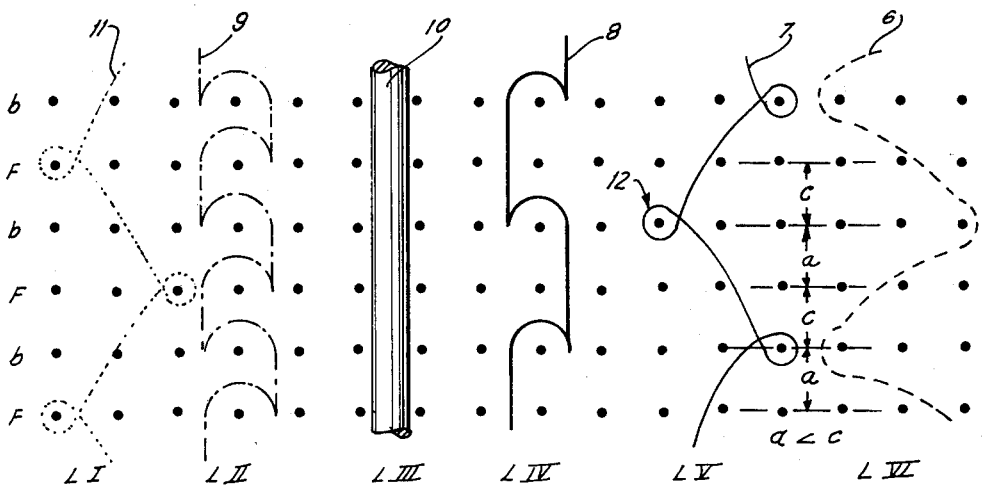
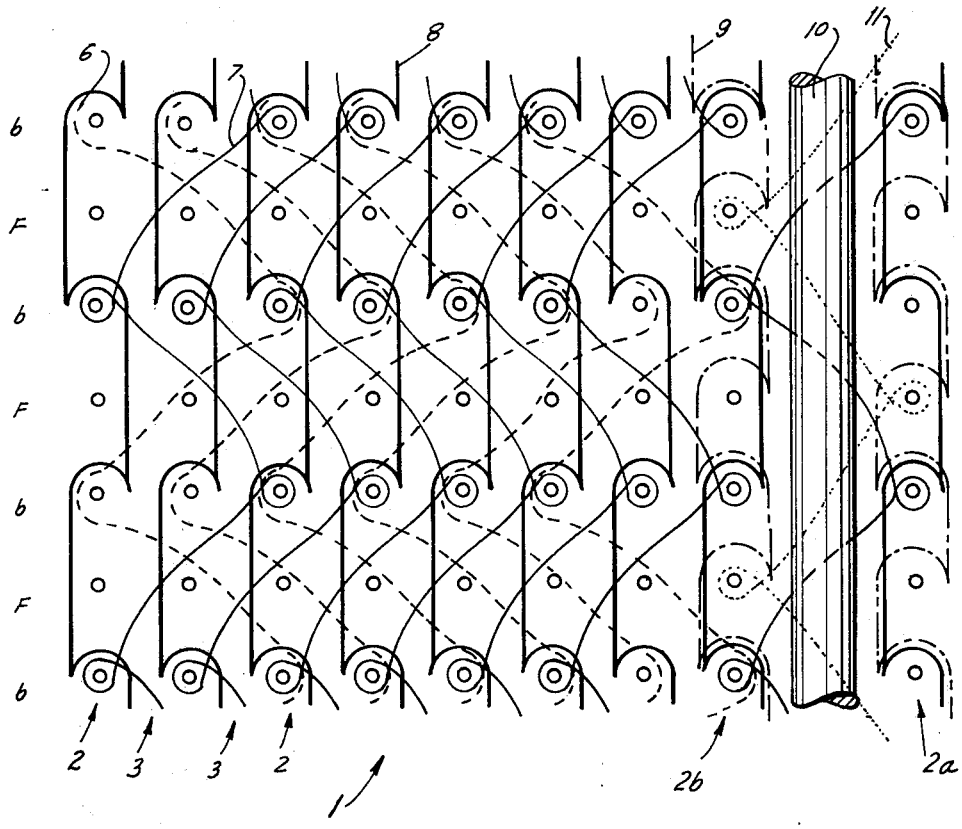
FIG. 3

SLIDE FASTENER SUPPORT AND METHOD OF WARP-KNITTING SAME

CROSS-REFERENCE TO RELATED APPLICATIONS

This application is related to my copending and commonly assigned patent applications Ser. Nos. 728,136 and 728,031 both filed on Sept. 30, 1976.

FIELD OF THE INVENTION

The present invention relates to a slide-fastener support tape and method of making same. More particularly this invention concerns a warp-knit support tape having a thickened edge adapted to receive a succession of straddling coupling teeth or heads.

BACKGROUND OF THE INVENTION

It is known to make a slide-fastener stringer half or a warp-knit tape, a monofilamentary coupling element lying on the edge of the tape and extending slightly transversely therefrom, and stitching securing this coupling element to the tape. Such a stringer half is suitable for use in light-duty and medium-duty slide fasteners. Nonetheless it cannot withstand the considerable transverse and longitudinal stresses which it would be subjected to if used in a heavy-duty slide fastener.

Thus it is standard practice in heavy-duty slide fasteners to use instead of a helicoidal monofilamentary coupling element a succession of discrete metal or synthetic-resin teeth which are secured to a thickened edge of the support tape. To this end the edge of the support tape is formed with a welt or the like so that the teeth or coupling heads can be mounted straddle-fashion on this edge.

When such a support tape is warp knit the customary prodecure is simply to load the endmost needle of the machine with the heaviest possible yarn so that the chain at this edge will be as thick as possible and form the above-described welt. Such a production method places a limit on the thickness which can be imparted to the edge chain in the warp-knit tape as the needle has a limited capacity that can only accpet yarns up to a certain gauge.

For this reason warp-knit support tapes for heavy-duty slide fasteners have not been adequately strong to withstand the considerable transverse pull exerted on the coupling heads of such slide fasteners since the edge welt is not sufficiently large or well integrated with the rest of the tape to form a good attachment for the teeth. Furthermore a warp-knit tape is frequently overly elastic in the longitudinal direction so that it can stretch and change the intertooth spacing of the fastener, allowing the fastener to open accidently.

OBJECTS OF THE INVENTION

It is therefore an object of the present invention to provide an improved slide-fastener support tape and method of making same.

Another object is the provision of a warp-knit slide-fastener support tape which has an edge region which is sufficiently thickened to provide a vary firm mounting even for use in a heavy-duty slide fastener.

Yet another object is to provide such a fastener support tape which can be made with a conventional warp-knitting machine.

Yet another object of the present invention is to provide such a slide-fastener support tape which has excellent dimensional stability, particlarly in the longitudinal direction, and on which coupling heads or teeth can be molded.

It is also an object of the invention to provide an improved slide-fastener stringer.

SUMMARY OF THE INVENTION

These objects are attained according to the present invention in a slide-fastener support tape comprising a relatively thin first warp yarn forming a longitudinally extending double wale and havng a succession of loops defining courses, a plurality of relatively thin warp yarns forming an array of longitudinally extending and transversely spaced single wales adjacent the double wale and each having a succession of loops at every other of the courses, a blind-lapped relatively thick warp yarn extending longitudinally between the double wale and the adjacent single wale at the edge of the array of single wales, a plurality of first weft yarns each laid into a plurality of the single wales, a second weft yarn lapped into the double wale and the adjacent single wale lying to one side of the thick warp yarn, and a third weft yarn lapped into the double wale and the adjacent single wale and lying to the other side of the thick warp yarn. Thus the relatively thick warp yarn that extends up next to the edgemost wale of the tape is firmly bound in place by a tube constituted by the second and third weft yarns.

In accordance with another feature of this invention the tape is produced on a Raschel knitting machine having a pair of needle bars. The double wale formed by the thin first warp yarn is knit with both the needle bars, whereas no more than one needle bar is used for any of the other of the patterned filaments, the blind-lapped thick warp yarn of course not passing through any needle. The gap for the blind-lapped thick warp yarn is formed by leaving one of the needles of the machine empty so that the space for this yarn is exactly the width of a wale.

In accordance with yet another feature of this invention the second and third weft yarns form loops at alternate courses, one of these weft yarns being knit with one of the needle bars and the other with the other needle bar.

With the system according to the present invention it is therefore possible to produce a slide-fastener support tape which is extremely rigid and which can readily be used to carry even the most heavy-duty coupling element straddle-fashion over the thickened edge. This thickened edge is formed mainly by the thick warp yarn that is blind-lapped into the tape. Since this yarn does not pass through a needle it can be much thicker than any of the other yarns so that it is possible to form a welt at this edge that is much larger than has hitherto been possible. Furthermore since this thick warp yarn extends straight up the edge of the tape it imparts its full longitudinal dimensonal stability to the edge of the tape and this edge will, therefore, not be able to stretch any more than the blind-lapped warp yarn.

According to yet another feature of this invention the lapped yarns which cross the thick yarn and form a tube holding this thick warp yarn in place are either tensioned so tightly during knitting or are tensioned subsequently by shrinking that they are embedded in the yarn. Thus it is possible to clip metal teeth over this edge without the danger of abrading and cutting the holding-in yarns.

In accordance with yet another feature of this invention the single wale at the edge of the array of single wales is turned into a double wale by chaining another first warp yarn up this wale using both needle bars. Thus the thick warp yarn is embraced between a pair of double wales and the lapped weft yarns holding it in place have loops securely anchored in these double wales.

In accordance with this invention if metal coupling heads are to be mounted astraddle the thickened edge of the tape the entire tape is formed of thermoplastic synthetic-resin material, preferably polyester yarns. When, however, the coupling heads are to be molded in place on the thickened edge of the tape all of the filaments at this edge are made of heat-resistant cotton, the balance of the tape being again made of polyester staple fiber yarn.

The term "blind lapped" as used herein to refer to the warp-extending cord or welt or bead cord, is intended to describe, in the usual sense, an inlaying without looping at the needles or warp-chain loops, the blind lapped yarn being merely held in place by the weft which bridges the warp chains.

The warp chains or pillars, which define valleys extending in the warp or longitudinal direction between them, can be of the type described in U.S. Pat. No. 3,708,830, i.e., of the single-bar or single-needle type bridged only by the weft. A warp gap adjacent this edge warp chain corresponding in location to the location which would have been occupied by the warp chain adjacent the edge warp chain or wale if the warp chains were uniformly spaced across the tape, and the bead-forming yarn or thread lying along the warp gap as a so-called "stationary" thread and held in place by the ground knit and especially the weft which is locked into the warp chains on both sides of the bead-forming yarn. The latter can be considerably thicker than the other threads of the ground knit.

The weft preferably includes at least one bead-binding thread or yarn which extends from side to side across the bead-forming yarn and is, to either side of the latter, looped into the edge warp chain and the other warp chain adjacent the warp gap.

It is indeed surprising that, in the manner described, it is possible to anchor a nonlooped or stationary thread in a knitted tape so firmly that it can serve to mount the coupling elements. The effect is even more pronounced when the binding yarn forms loops at the warp chains, i.e. is itself knitted into the ground knit as a "tricot" or "fabric" yarn. The necessary force for gripping the stationary or bead-forming thread, is as noted, generated at least in part by making the binding yarn shrinkable and shrinking it after it has been knitted over the stationary thread.

On one embodiment of the invention the binding thread can be a simple inlaid weft, while in another it is a mesh-forming thread having its own loops at locations at which it reverses direction.

In the first case the inlaid weft is laid over three needles or wale positions in an 0—0/3—3 pattern while in the second case the binding thread forms a so-called fabric pattern, e.g. 2-2/1-0. The bead-forming yarn has preferably a 0—0 pattern.

While the warp chains are preferably single-needle warps of 1-0/0-1 patter as described in the aforementioned patent, I do not mean to exclude other ground knits as described, for example, in the above-identified copending applications.

When two such bead-forming yarns are laid in 0—0 pattern in place of the omitted warp chains, the binding threads, preferably in the aforementioned fabric pattern 2-3/1-0 or 1-0/2-3 lie above and below each of the bead-forming yarns individually.

In spite of the face that all of the yarns, except the binding threads and bead-forming threads which preferably are cotton, consist of a thermoplastic synthetic-resin (e.g., polyester staple fiber), it is possible to injection mold thermoplastic coupling members into the bead. Moreover, since the bead is elastically yieldable it can accommodate clamped on metal coupling members which can have sharp edges.

According to another aspect of the invention a stringer half comprises a knitted type formed on a Raschel knitting machine with an enlarged edge bead straddled by the coupling members of the stringer.

The ground or base knit consists of right-left Raschel knit with inlaid weft, fabric-pattern looped weft and wale-forming warp chains (see U.S. Pat. No. 3,708,830), while the edge-bead-forming portion of the tape is formed by right-right Raschel knitting. A warp chain is omitted adjacent the edge warp chain at this portion and a thick-forming thread (stationary thread) is laid into the gap formed by omitting the warp chain.

The bead-forming thread is held on one side by a looped weft thread of the ground knit (bridging the edge warp chain) and the next warp chain bordering the gap while an additional looped weft (also of so-called fabric pattern) bridges these two warp chains so that the looped weft threads form a tub enclosing the bead-forming thread.

Also, the latter two warp chains form wale pillers on both surfaces of the tape, i.e., are composed of front and back/back warp yarns.

BRIEF DESCRIPTION OF THE DRAWING

The above and other objects, features and advantages of the present invention will become more readily apparent from the following description, reference being made to the accompanying drawing in which:

FIG. 3 is a large-scale diagrammatic view illustrating the knit tape of FIGS. 1 and 2; and FIG. 4 is a point-paper diagram illustrating the patterning of the knit of FIG. 3.

SPECIFIC DESCRIPTION

Figure 2:
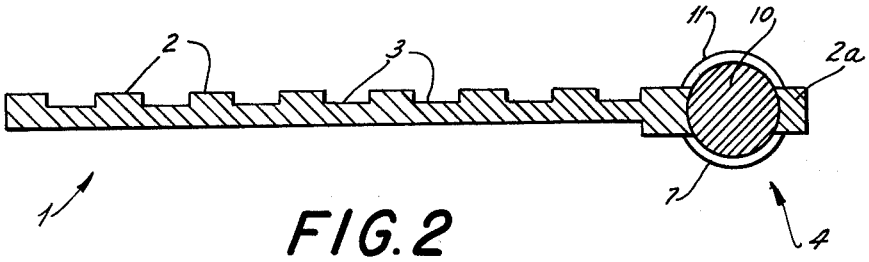
FIG. 2 is a section taken along line II —II of FIG. 1 showing only the support tape.
Figure 1:
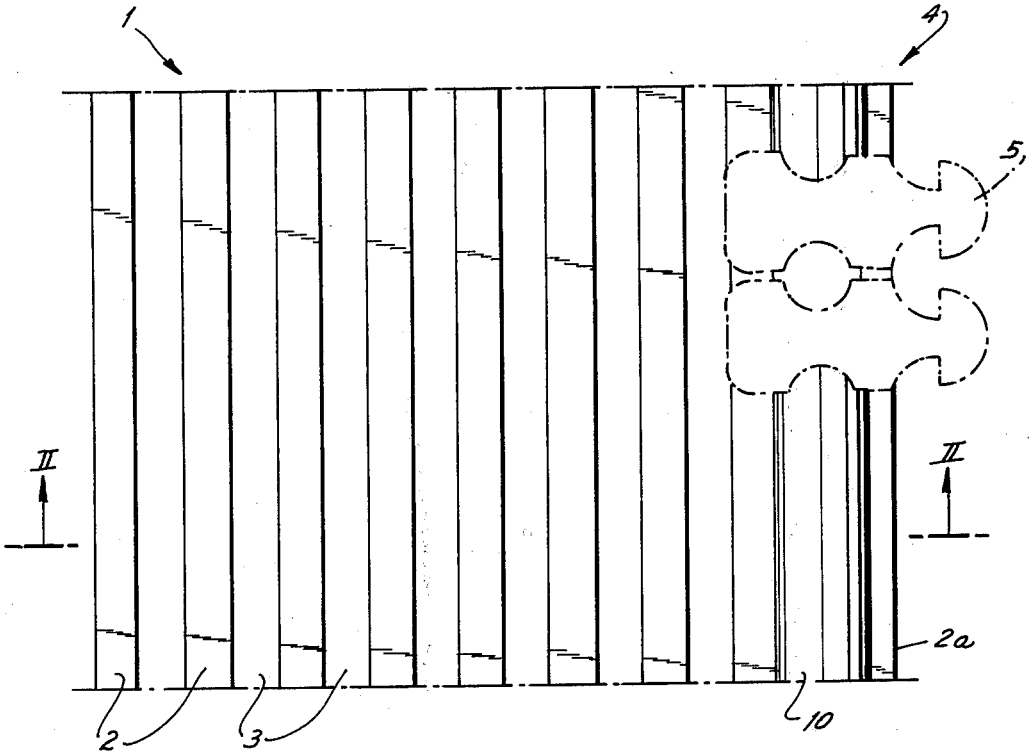
FIG. 1 is a top view of a portion of a slide-fastener stringer half according to this invention.

As shown in FIGS. 1 and 2 a slide-fastener support tape 1 has a plurality of single wales 2 extending longitudinally and spaced transversely from each other by valleys 3. In addition this tape 1 has at its thickened edge 4 a pair of spaced apart double wales *2a* and *2b,* the former being at the very edge of the tape. It is possible to mount synthetic-resin coupling teeth 5 on this thickened edge 4 straddle fashion, that is with one leg of the tooth or element 5 engaging one face of the tape and the other leg of the element 5 engaging the opposite face at the thickened edge 4.

This tape 1 is knit on a Raschel knitting machine having a front needle (f) a back needle bar (b), and six bars LI –LVI. The distance *a* between each course formed by a front needle bar and the following course formed by a back needle bar is greater than the distance formed between each course formed by a back needle bar and the following course formed by a front needle bar.

As further shown in FIGS. 3 and 4 the tape 1 is formed across its full width in every wale with warp filaments 8 that are knitted with guide bar LIV only on the back needle bar. Across the full width of the tape in the region of the single wales 2 only there are weft filaments 6 laid in by guide bar LVI and reversing only at courses formed by the back guide bar. Furthermore there is in each of the wales 2*a* and 2*b* a pillar or chain formed by the guide bar LII knitting with both the front and back needle bars of the machine so as to form a so-called double wale. The guide bar LI laps a weft filament 11 with the front needle bar so as to form closed loops 12 alternating between the double wales 2*a* and 2*b*. Similarly the guide bar LV knits another weft filament 7 with only the back needle bar again between the two double wales 2*a* and 2*b*. Finally a relatively thick warp yarn 10 is blind lapped into the space left between the wales 2*a* and 2*b* by leaving one of the needles of the knitting machine empty. The yarn 7 will lie on one side of this yarn 10 and the yarn 11 on the other side so as to bind it securely in place as if in a tube. Furthermore since each of the wales 2*a* and 2*b* is a double wale having an open loop at each course of the tape 1, the yarns 7 and 11 will be securely anchored at every one of the loops 12.

Thus the yarns are patterned as follows:

laid-in weft yarns 6 (back) (LVI) —2—2/6—6/4—4-/0—0, lapped weft (fabric pattern) yarn 7 (back) (LV) —-4—4/2-0/2—2/4-6, chained warp yarn 8 (back) (LIV) —2—2/2-0/0—0-/0-2, chained warp yarn 9 (front and back) (LII) —2-0-/0-2, blind-lapped warp (stationary thread) yarn 10 (LIII) —0—0, and lapped weft (fabric pattern) yarn 11 (front) (LI) —-4-6/4—4/2-0/2—2. It is noted that in patterning notations for a double-needle bar machine the count is doubled.

In accordance with the present invention the yarns 7, 9, 10, and 11 may all be made of cotton so that the thickened edge 4 is heat-resistant and synthetic-resin coupling elements can be molded directly thereon. The other yarns 6 and 8 may be of polyester or similar thermoplastic synthetic resin. It is also noted that the filaments 7 and 11 may be shrinkable or so tensioned that they imbed themselves in the thick warp yarn 10 so that as these metallic coupling elements 5 are secured to the thickened edge 4 the edges will not engage these filaments 7 and 11 and cut them.

Tape according to this invention has extremely good longitudinal dimensional stability as the blind-lapped yarn 10 extends parallel to the edge and imparts its full inelasticity to this edge 4. Furthermore this yarn 10 is so integrally bounded into the tape that it can withstand extremely strong transverse forces and prevent the coupling teeth 5 from pulling free of the tape.

I claim:

1. A slide-fastener support tape comprising:

a relatively thin first warp yarn forming a longitudinally extending double wale and having a succession of loops defining courses;

a plurality of relatively thin second warp yarn forming an array of longitudinally extending and transversely spaced single wales adjacent said double wale and each having a succession of loops at every other of said courses;

a blind-lapped relatively thick warp yarn extending longitudinally between said double wale and the adjacent single wale at the edge of said array of single wales;

a plurality of first weft yarns each laid into a plurality of said single wales;

a second weft yarn lapped into said double wale and said adjacent single wale, and lying to one side of said thick warp yarn; and a third weft yarn lapped into said double wale and said adjacent single wale and lying to the other side of said thick warp yarn.

2. The tape defined in claim 1 wherein said double wale also includes one of said second warp yarns having loops at every other course.

3. The tape defined in claim 1 wherein said thick warp yarn and said second and third weft yarns are heat resistant and said first warp yarn and said first weft yarns are thermoplastic.

4. The tape defined in claim 1 wherein said second and third weft yarns form loops at every other course.

5. The tape defined in claim 4 wherein one of said second and third weft yarns forms loops at courses alternating with the courses at which the other of said second and third weft yarns forms loops.

6. A method of making a slide-fastener support tape with a knitting machine having a pair of needle bars, said method comprising the steps of:

chaining a relatively thin first warp yarn with both of said needle bars to form a longitudinally extending double wale;

chaining a plurality of relatively thin second warp yarns with only one of said needle bars to form an array of longitudinally extending and transversely spaced single wales adjacent said double wale;

spacing the edge single wale of said array by a gap from said double wale;

blind lapping a relatively thick warp yarn into said gap;

inserting a plurality of first weft yarns each across a plurality of said single wales;

lapping a second weft yarn into said double wale and said edge single wale to one side of said thick warp yarn; and lapping a third weft yarn into said double wale and said edge single wale to the other side of said thick warp yarn.

7. The method defined in claim 6 wherein said first weft yarns are laid into said single wales.

8. The method defined in claim 6 wherein said second weft yarn is lapped only with one of said needle bars and said third weft yarn only with the other needle bar.

9. The method defined in claim 6, further comprising the step of chaining another such relatively thin first warp yarn with both of said needle bars into said edge single wale to make same into another double wale.

10. The method defined in claim 6, further comprising the step of shrinking said second and third weft yarns to imbed same into said thick warp yarn after lapping of said second and third weft yarns.

11. A slide-fastener stringer half comprising a knitted support tape having a coupling edge formed with a bead and a plurality of coupling members secured to and straddling said bead, said tape being formed with:

warp yarns in the configuration of respective warp chains defining longitudinally extending pillars and valleys between said pillars;

inlaid weft yarns extending between said warp chains;

looped yarns extending between said warp chains across the width of said tape;

a gap formed in said warp chains between an edge-warp chain at said coupling edge and a further warp chain, a first of said looped yarns extending back and forth between said edge and further warp chains;

a bend-forming thread lying in said gap and flanked on one side by one of said looped yarns; and a second looped yarn flanking said thread on the opposite side thereof and extending back and forth between said edge and further warp chains, said first and second looped yarns forming where they reverse direction loops knitted into the respective warp chains, said edge and further warp chains being each of double yarns constituting pillars on both surfaces of said tape.

12. The stringer half defined in claim 11 wherein said thread and said first and second looped yarns are composed of cotton and the other yarns are composed of polyester staple fibers.

13. The stringer half defined in claim 11 wherein in right-right Raschel terminology said warp yarns except said edge and further warp yarns are of 2—2/2-0/0—0-/0-2 pattern, said edge and further warp yarns are of 2-0/0-2 pattern, said first looped yarn is of 4—4/2-0-/2—2/4-6 pattern, said second looped yarn is of 4-6-/4—4/2-0/2—2 pattern, said thread is of 0—0 pattern and said inlaid weft yarns are of 2—2/6—6/4—4/0—0 pattern.

* * * * *